US007353910B2

(12) United States Patent
Klingler

(10) Patent No.: US 7,353,910 B2
(45) Date of Patent: Apr. 8, 2008

(54) SIMPLE BELAY DEVICE

(76) Inventor: Gregory Lee Klingler, 824 E. Iowa Ave., Denver, CO (US) 80210

( * ) Notice: Subject to any disclaimer, the term of this patent is extended or adjusted under 35 U.S.C. 154(b) by 94 days.

(21) Appl. No.: 11/308,064

(22) Filed: Mar. 5, 2006

(65) Prior Publication Data

US 2007/0205048 A1 Sep. 6, 2007

(51) Int. Cl.
*A62B 1/00* (2006.01)

(52) U.S. Cl. ..... 182/5; 182/192

(58) Field of Classification Search ..... 182/5, 182/61, 191–193; 188/65.2–65.5
See application file for complete search history.

(56) References Cited

U.S. PATENT DOCUMENTS

| | | | | |
|---|---|---|---|---|
| 3,814,210 | A * | 6/1974 | Hoffman | 182/6 |
| 4,531,610 | A | 7/1985 | Fertier et al. | 182/5 |
| 4,667,772 | A * | 5/1987 | Kammerer | 182/6 |
| 5,217,092 | A | 6/1993 | Potter | 188/65.4 |
| 5,360,083 | A | 11/1994 | Hede | 182/5 |
| 5,577,576 | A | 11/1996 | Petzl et al. | 188/65.4 |
| 5,597,052 | A | 1/1997 | Rogleja | 188/65.5 |
| 5,671,822 | A | 9/1997 | Phillips | 182/5 |
| D413,786 | S | 9/1999 | Graham | |
| 6,378,650 | B2 * | 4/2002 | Mauthner | 182/5 |
| 6,561,313 | B2 * | 5/2003 | Hewlett et al. | 182/5 |
| 6,681,891 | B2 * | 1/2004 | Richard et al. | 182/5 |
| 2003/0034203 | A1 | 2/2003 | Hewlett et al. | 182/5 |
| 2005/0039979 | A1 * | 2/2005 | Gorman et al. | 182/5 |

FOREIGN PATENT DOCUMENTS

FR 2626184 A1 * 7/1989

* cited by examiner

*Primary Examiner*—Alvin Chin-Shue

(57) ABSTRACT

A simple, economical, and highly effective auto locking belay device is presented, certain embodiments of which contain no moving parts. The simplicity of the device is due to the fact that it derives certain functionality from its attachment carabiner that would normally be found within an auto-locking belay device itself. In its simplest form, the Device (10) comprises only a Body (14) with an Inner Channel (16) and a Pin (12). The attachment carabiner supports the path of the rope through the device, constrains an axis of rotation around which the device rotates, and provides one of two surfaces between which the rope is pinched. The device is able to extract these functions from the carabiner due to a unique, and counter-intuitive, placement of the carabiner within the same geometric plane as the path of the rope through the device.

4 Claims, 9 Drawing Sheets

SIMPLE BELAY DEVICE

BACKGROUND

1. Field of Invention

This invention pertains to a device used, in conjunction with a rope, to stop a falling object and/or to lower an object in a controlled manner. In particular it pertains to a belay device and, more specifically, to an auto-locking belay device. The subject invention has application in the sport of rock climbing and in certain industrial applications for fall protection.

2. Prior Art

In the sport of rock climbing, a belay device is used to protect a climber from injury in the case of a fall. Generally the climber wears a harness to which one end of a rope is attached. The rope passes through a belay device that is often attached to the harness of another person, the "belayer". The belayer operates the belay device and typically remains at a stable point while the climber ascends. When the climber is "lead" climbing, the climber drags the rope up the rock as he ascends. At various points during the ascent, the climber clips the rope into metal loops (carabiners) that, in turn, are attached to the surface of the rock. When the climber is "top-rope" climbing, the rope extends down toward the climber from above. In the case of lead climbing, the belayer feeds out rope as the climber ascends. In the case of top-rope climbing, the belayer takes in rope as the climber ascends. In either case, if the climber falls, the belayer must grasp the rope securely by means of the belay device. The fall is therefore stopped by means of the belay device and the climber comes to rest suspended from above by the rope. Thereafter, the belayer may gently lower the climber to the ground by operating the belay device so as to gradually release tension on the rope. Anyone experienced in rock climbing is familiar with this practice and with the various forms of belay devices.

Over the years many devices have been developed to grip a rope and to control the rate of movement of rope, and many of these devices have been used for the purpose of belaying or for the very similar purpose of descending. Much of the patented prior art deals with descenders, many of which can also be used as belay devices. A descender is designed to lower a person or object in a controlled fashion.

The devices of the prior art can be broadly categorized into two classes:

The first class, manual belay devices, consists of relatively simple devices that contain no moving parts. These devices, many of which are very effective, rely entirely upon frictional forces developed within a torturous path through which the rope runs. A positive attribute of this class is that these devices are inexpensive since they are based on simple designs and contain no moving parts. On the negative side, these devices require action on the part of the belayer in order to stop a fall. If the belayer is inattentive or looses his grip, the result can be disastrous. Also on the negative side, it is difficult to feed rope quickly through these devices due to the torturous path of the rope. Examples include U.S. Pat. No. D413,786 to Graham, U.S. Pat. No. 5,217,092 to Potter, and U.S. Pat. No. 5,671,822 to Phillips.

The second class, auto-locking belay devices, generally consist of relatively more complicated designs, often with moving parts, that have the benefit of requiring no action on the part of a belayer in order to stop a fall. Often, such devices consist of one or more cams over which the rope runs. The cams either have an off-center axis of rotation or a variable radius that increases as the cam rotates. At least one such cam in each such device is usually designed such that, under normal climbing conditions, the rope slips over the surface of the cam and the cam remains stationary but, in the event the climber falls, the friction developed by the rapid passage of the rope along the cam surface causes the cam to rotate. Due to the shape of the cam, rotation thereof causes the rope to be pinched and stops the rope. These rotating cams are often spring loaded so as to resist rotation until a certain threshold frictional force has been achieved. A positive attribute of this class is that these devices require little or no action on the part of the belayer in order to stop a fall. On the negative side, these devices are relatively more expensive since they are more complicated designs and often have multiple moving parts. The presence of a moving part usually implies the requirement for manual labor in the assembly of that part which, in turn, implies relatively higher manufacturing cost. Examples of these auto-locking devices include U.S. Pat. No. 4,531,610 to Fertier et. al., U.S. Pat. No. 5,360,083 to Hede, U.S. Pat. No. 5,577,576 to Petzl et al., and U.S. Pat. No. 5,597,052 to Rogleja.

At least one device has been developed which achieves the enhanced functionality of the auto-locking class of belay devices, while maintaining the relative simplicity of design found in the manual class of belay devices. The device presented in US Patent Application Publication No. US 2003/0034203 A1 by Hewlett et al. is such a device. Hewlett's device is auto-locking yet has no moving parts.

All of the auto-locking belay devices contain two braking surfaces which, in one configuration are sufficiently separated so as to allow a rope to easily pass between them, and in another configuration are sufficiently close so as to pinch a rope that is positioned between them. The forces on the rope from the fall of a climber cause the device to shift from the former configuration to the latter configuration, the pinch on the rope by the braking surfaces thus stopping the rope and arresting the fall of a climber. Since the two braking surfaces must move relative to each other in order to pinch the rope, it would seem unlikely that an auto-locking belay device could be made which has no moving parts. Hewlett's device overcomes this apparent restriction by relying on the attachment carabiner to provide one of the braking surfaces. Therefore, although Hewlett's device itself has no moving parts, the device moves with respect to its attachment carbiner in the event of a fall by a climber, thus causing two braking surfaces to move with respect to each other, one braking surface being on the carabiner and the other being within Hewlett's device.

In order for an auto-locking belay device to work well, there are a great many design characteristics that must be optimized and that often appear to be in conflict with each other. Some ideal characteristics of a belay device are:

It should be simple to operate. A device that is simple to operate allows the belayer to pay more attention to the climber and less to the operation of the device.

It should be strong, yet lightweight and small. Since climbers often have to carry a substantial amount of equipment, weight and size are important factors.

It should grip the rope very tightly when the climber falls. Sometimes climbers fall from heights significantly above their last rope attachment point. The device must be able to stop a heavy climber who has been in a free fall.

It should allow easy passage of the rope as the climber is climbing.

It should render the climber in a safe position should the belayer accidentally loose his grip either on the device itself or on the rope.

It should allow for the belayer to easily lower the climber in a controlled fashion.

Its manufacturing costs should be such that it is affordable.

It should not cause undue wear on the rope.

These desired attributes can lead to design features that are in conflict with each other. For example:

- a very strong device might be too large or too heavy;
- a device that grips the rope very tightly might not allow the belayer to easily lower the climber;
- a device that grips the rope very tightly might cause excessive wear on the rope;
- a device that allows easy passage of the rope might not grip the rope sufficiently tightly when a climber falls;
- a device which renders the climber in a safe position even if the belayer looses his grip, might have excessive manufacturing costs due to greater complexity.

Although Hewlett's device offers an innovative approach to a simple auto-locking belay device, it poses design restrictions that limit the ability to optimize a device for all of the desired characteristics. An important feature of Hewlett's device is an elongated opening through which the carabiner is clipped. When the carabiner is positioned in one portion of this opening, a rope is able to pass freely. When the carabiner is positioned in another portion of this opening, the rope is pinched and prevented from moving. The rope forces resulting from the fall of a climber cause the carabiner to move from the first position within the opening to the second position within the opening. Hewlett's device thus stops the rope by causing the rope to be pinched by the tubing of the carabiner, the carabiner tubing lying across the rope and pinching the rope against a surface of Hewlett's device.

One negative aspect of Hewlett's device is that the size of the carabiner braking surface is relatively small. Since the carabiner tubing which forms the braking surface passes across the rope and is directly perpendicular to the path of the rope, the size of that braking surface is limited based on the tubing radius of a standard locking carabiner. It is possible that a significant force, transmitted to such a small braking surface, can cause damage to the rope.

Another negative aspect of Hewlett's device is that it greatly limits design flexibility with respect to the physical concept of mechanical advantage. In the locked configuration, the carabiner lies directly above, and in contact with, the rope. Also, the centerline of the carabiner tubing that passes through the opening serves as the axis of rotation around which Hewlett's device can rotate with respect to the carbiner. This means that the distance between the axis of rotation and the rope pinch point is equal to the radius of the carabiner tubing. As will be explained in the description of the subject invention, the aforementioned distance is a critical variable in determining the mechanical advantage between the force on the rope from a fallen climber and the pinch force exerted on the rope by the belay device.

The devices described in the above mentioned patents, do not disclose, teach or illustrate the unique structure, function and advantage of the subject belay device.

SUMMARY

The essence of the present invention is a simple auto-locking belay device for use in the sport of rock climbing or for certain industrial applications involving fall protection. The subject invention offers flexible design characteristics to achieve optimal functionality with a device that is both simple to use and inexpensive to manufacture. Certain embodiments of the subject invention contain no moving parts. A key innovation of the subject invention, unlike belay devices of the prior art, is the placement of the carabiner in the same geometric plane as the plane of the rope path through the belay device. This unique, and counter-intuitive, carabiner placement yields a device that overcomes limitations found in the prior art.

Objects and Advantages

In view of the foregoing, it is a primary object of the present invention to provide a simple belay device that achieves an optimal balance of desired performance characteristics that can often be in conflict with one another. Of particular note is the fact that this device is small, easy to use, able to grip the rope very firmly, yet requires minimal force to lower a climber in a controlled fashion. Design parameters of the subject invention are flexible, such that different embodiments can be optimized for different use applications.

Another object is that the device requires little or no action on the part of the belayer in order to stop a fall. If the belayer releases his grasp on the present invention altogether, a fall will be stopped.

Still another object is that the device is inexpensive relative to its performance features. With the exception of a pin, the entire device can be constructed from one inexpensive piece of material. Certain embodiments of the subject invention contain no moving parts.

Still another object is that the device provides a simple means for a fallen climber to be lowered to the ground in a gradual and controlled fashion. With the present invention, the belayer may lower a climber simply by exerting a relatively small force on a small, yet comfortable, lowering handle; the rate of descent being in direct proportion to the force exerted by the belayer.

Still another object is that the device grips a rope securely, even in the case of a fall of a heavy climber.

Still another object is that the device does not cause undue wear on a rope. The path of the rope through the present invention contains only smooth surfaces and all turns are of gradual curvature. The device contains no teeth or rough surfaces with which to grip the rope. The surface that pinches the rope can be made with sufficient area so as to distribute the pinch force in a manner that does not cause damage or excessive wear to the rope.

Still another object is that the device is relatively small and lightweight.

Still another object is that the device contains a relatively smooth rope path that allows the belayer to feed out rope very quickly.

These and other objects of the subject invention will become apparent to those familiar with the different types of belay devices when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

DRAWING FIGURES

FIG. 1 presents an exploded view of a First Embodiment Belay Device, illustrating its simplicity.

FIG. 2 presents another exploded view of the First Embodiment Belay Device along with a section of rope and a carabiner, illustrating the respective positions of the pieces.

FIG. 3 presents the First Embodiment Belay Device attached to the carabiner and with the rope in place for belaying FIG. 4 presents a view similar to that of FIG. 3 but with a front surface of the First Embodiment Belay Device cut away to expose the relative positions of the rope and the carabiner within the device.

Figure 6:
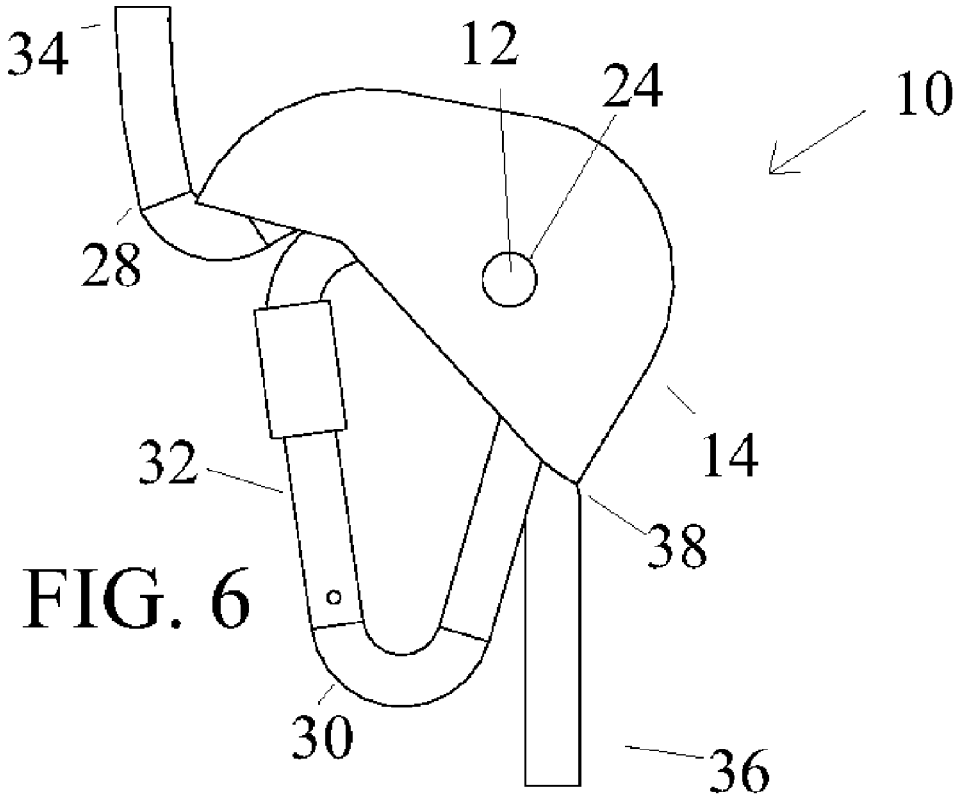
FIG. 6 shows the relative positions of the device, the rope, and the carabiner after the First Embodiment Belay Device has locked the rope.
Figure 7:
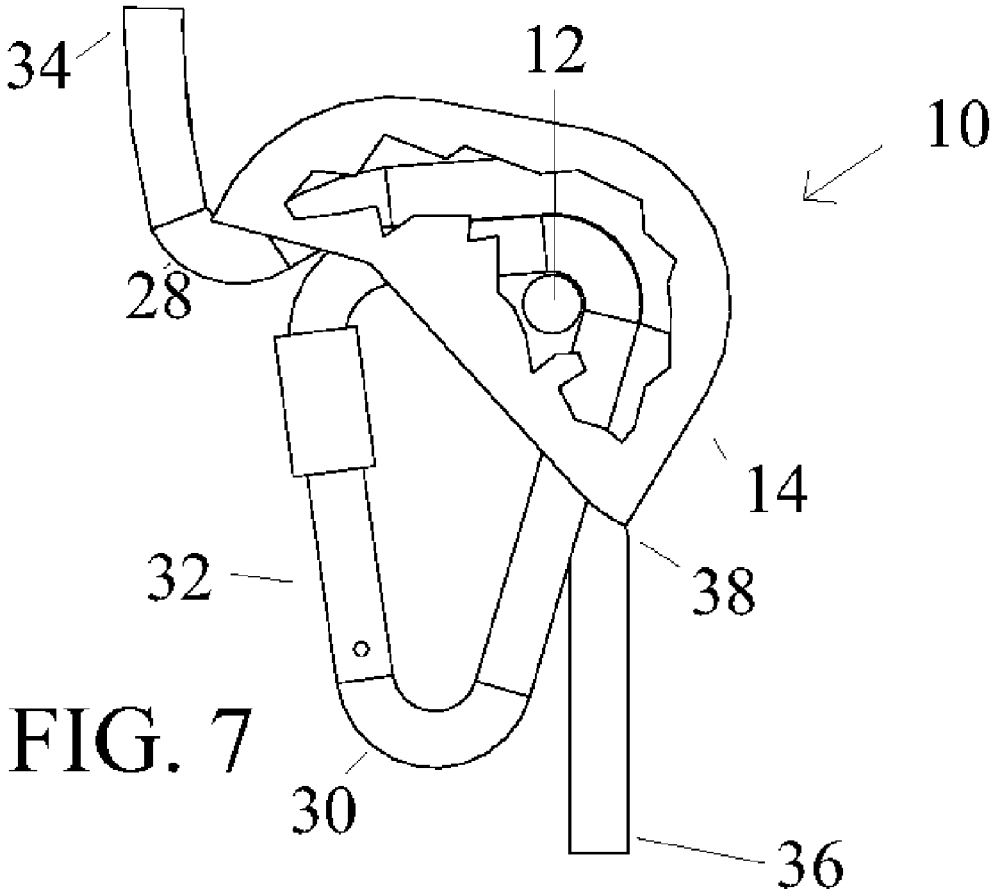

FIG. 7 presents a view similar to that of FIG. 6 but with a front surface of the First Embodiment Belay Device cut away to expose the relative positions of the rope and the carabiner within the device.

Figure 8:
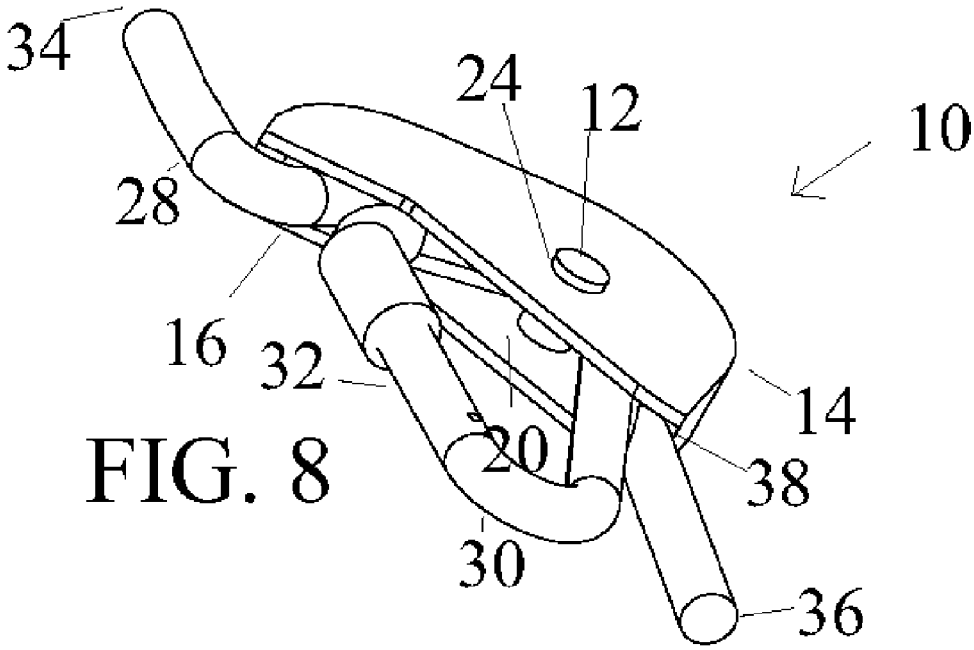

FIG. 8 presents a perspective view of the device, the rope, and the carabiner after the First Embodiment Belay Device has locked the rope, illustrating the particular portion of rope that is pinched in order to lock the rope against movement.

Figure 9:
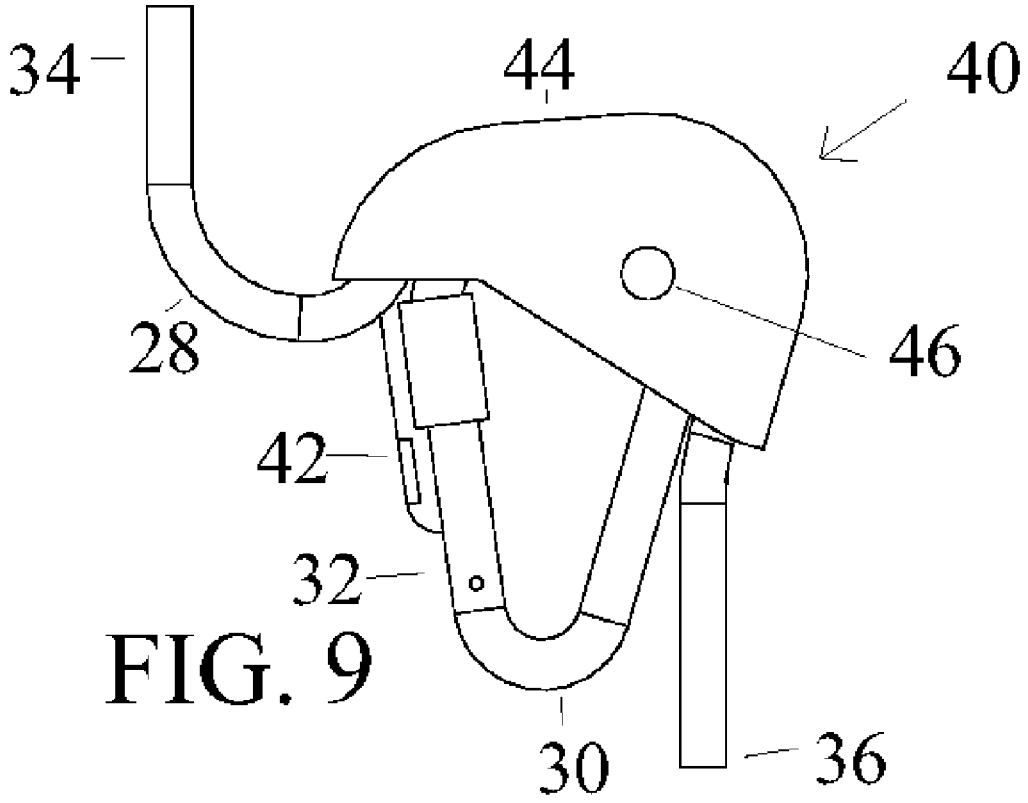

FIG. 9 presents a Second Embodiment Belay Device, a rope, and a carabiner. The Second Embodiment Belay Device contains an extension arm to aid in lowering a climber and to provide certain other enhancements.

Figure 10:
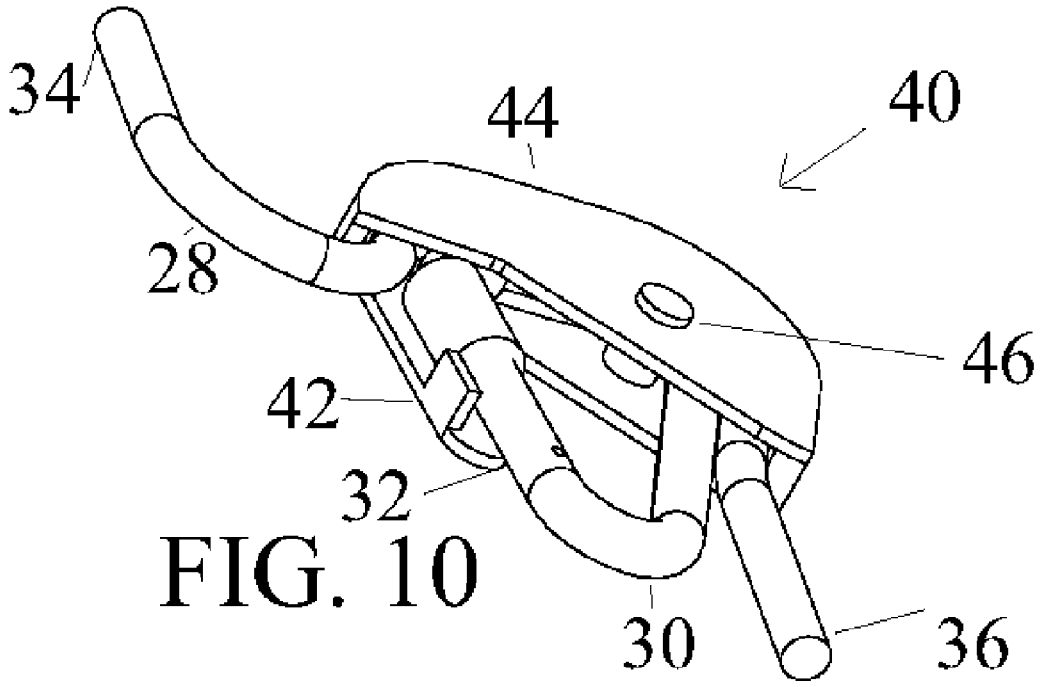

FIG. 10 presents a perspective view of the Second Embodiment Belay Device, rope, and carabiner.

Figure 11:
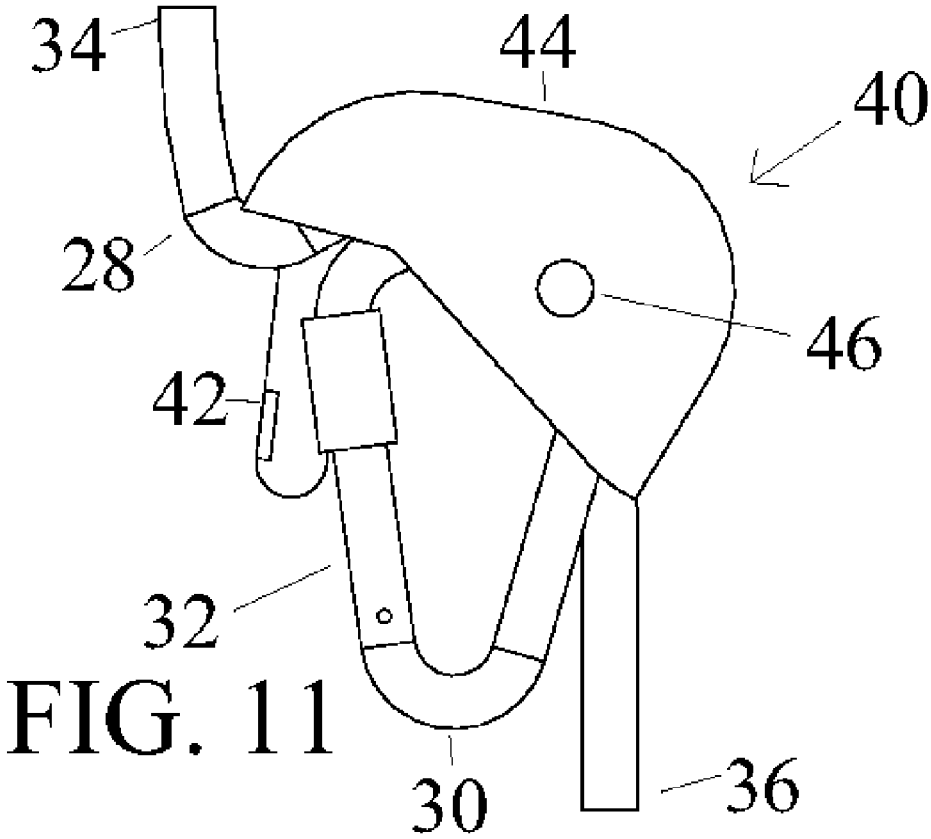

FIG. 11 illustrates the relative positions of the Second Embodiment Belay Device, the rope, and the carbiner after the device has locked the rope.

Figure 12:
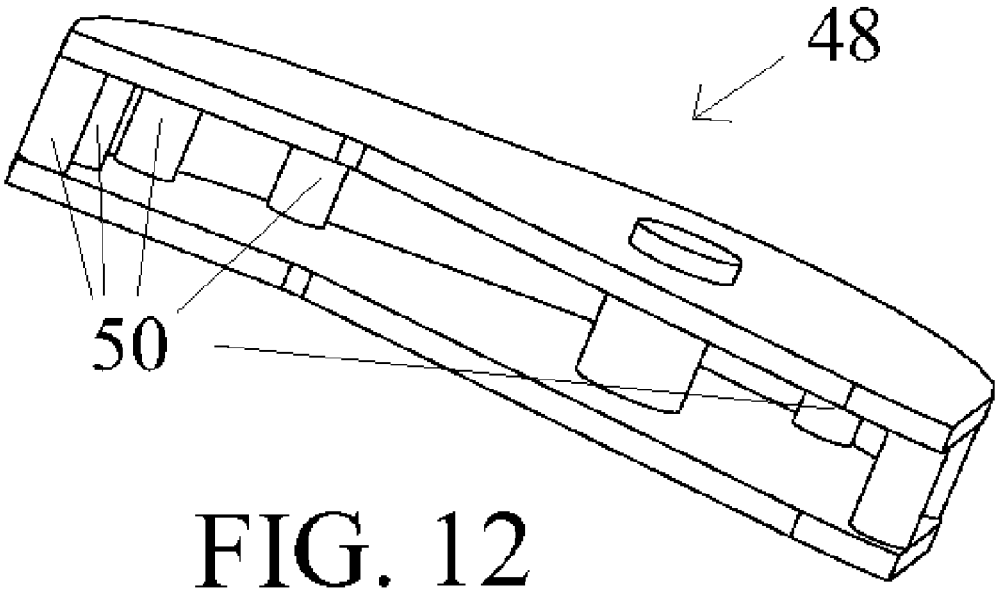

FIG. 12 presents a Third Embodiment Belay Device in which separate cylindrical pieces, rather than one continuous surface, are employed to confine the rope against upward movement.

Figure 13:
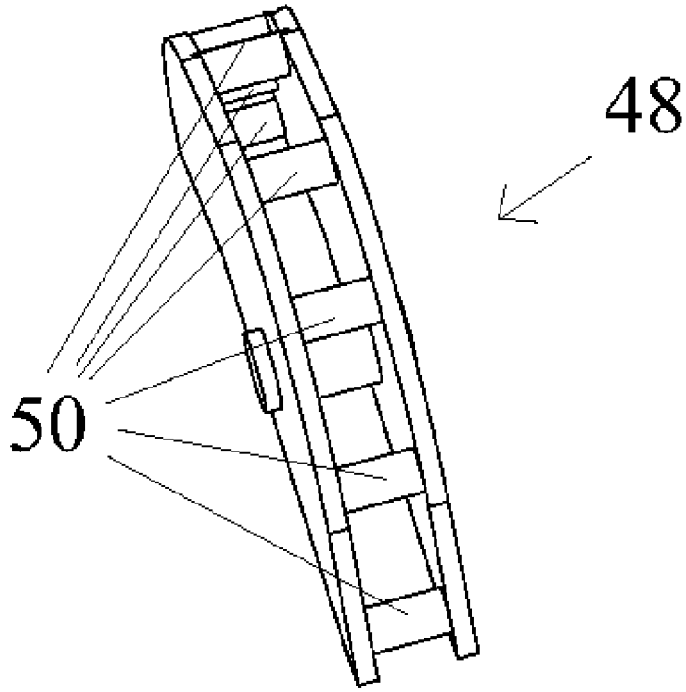

FIG. 13 presents a top-down view of the Third Embodiment Belay Device.

Figure 14:
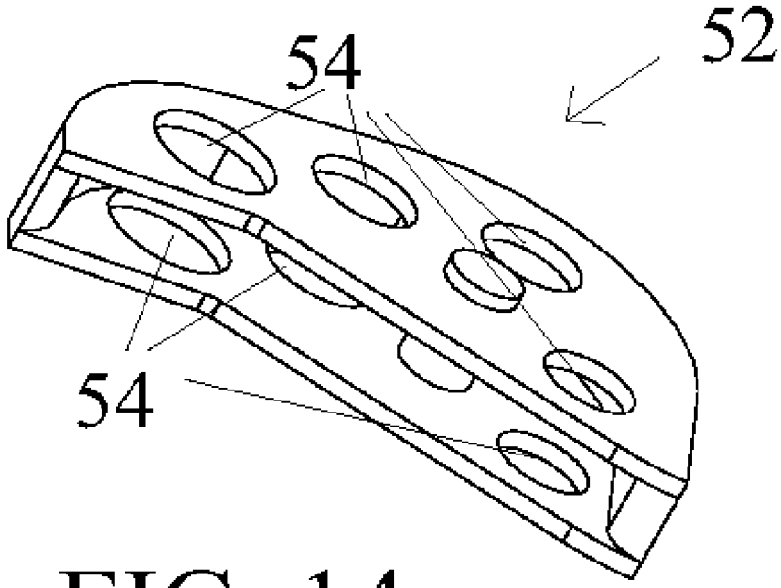

FIG. 14 presents a Fourth Embodiment Belay Device containing several openings in the side faces of the device to decrease weight.

Figure 15:
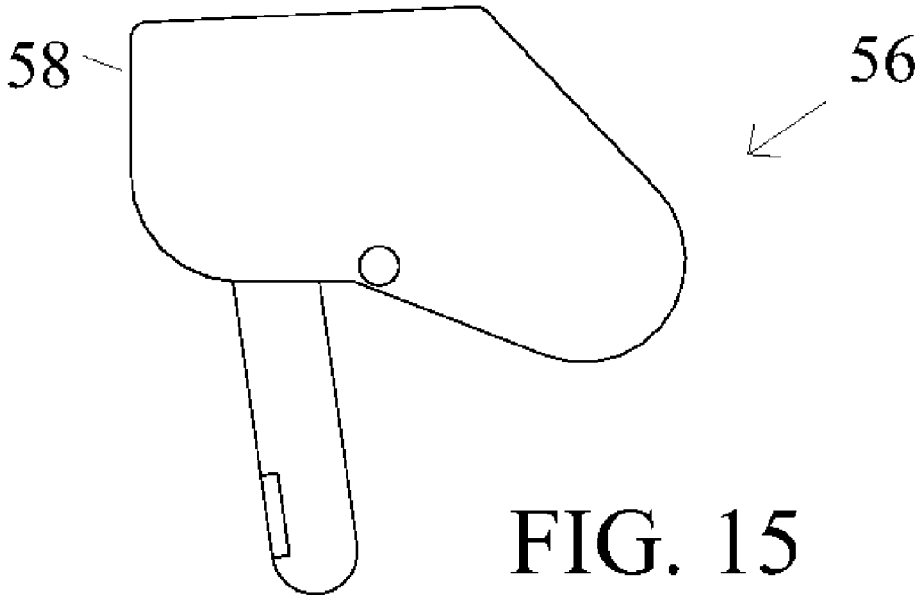

FIG. 15 presents a Fifth Embodiment Belay Device, which functions by locking the rope against a top surface of the carabiner, rather than by locking the rope against a side surface of the carabiner.

Figure 16:
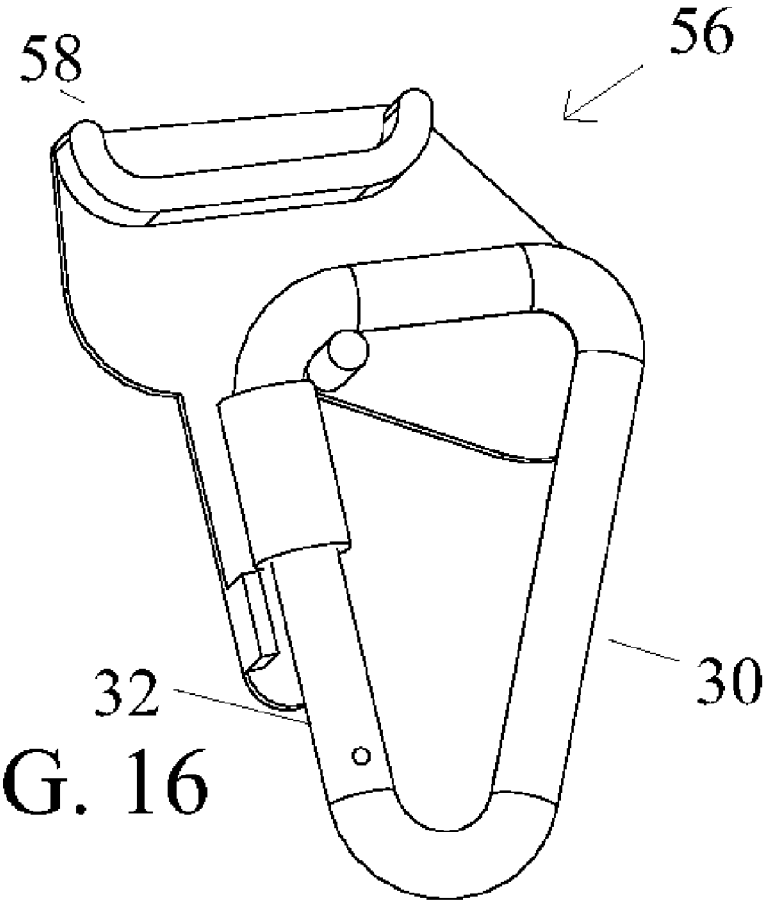

FIG. 16 presents a cut away view of the Fifth Embodiment Belay Device and a carabiner. The front surface of the Fifth Embodiment Belay Device has been removed in order to show the relative positions of the device and the carabiner.

Figure 17:
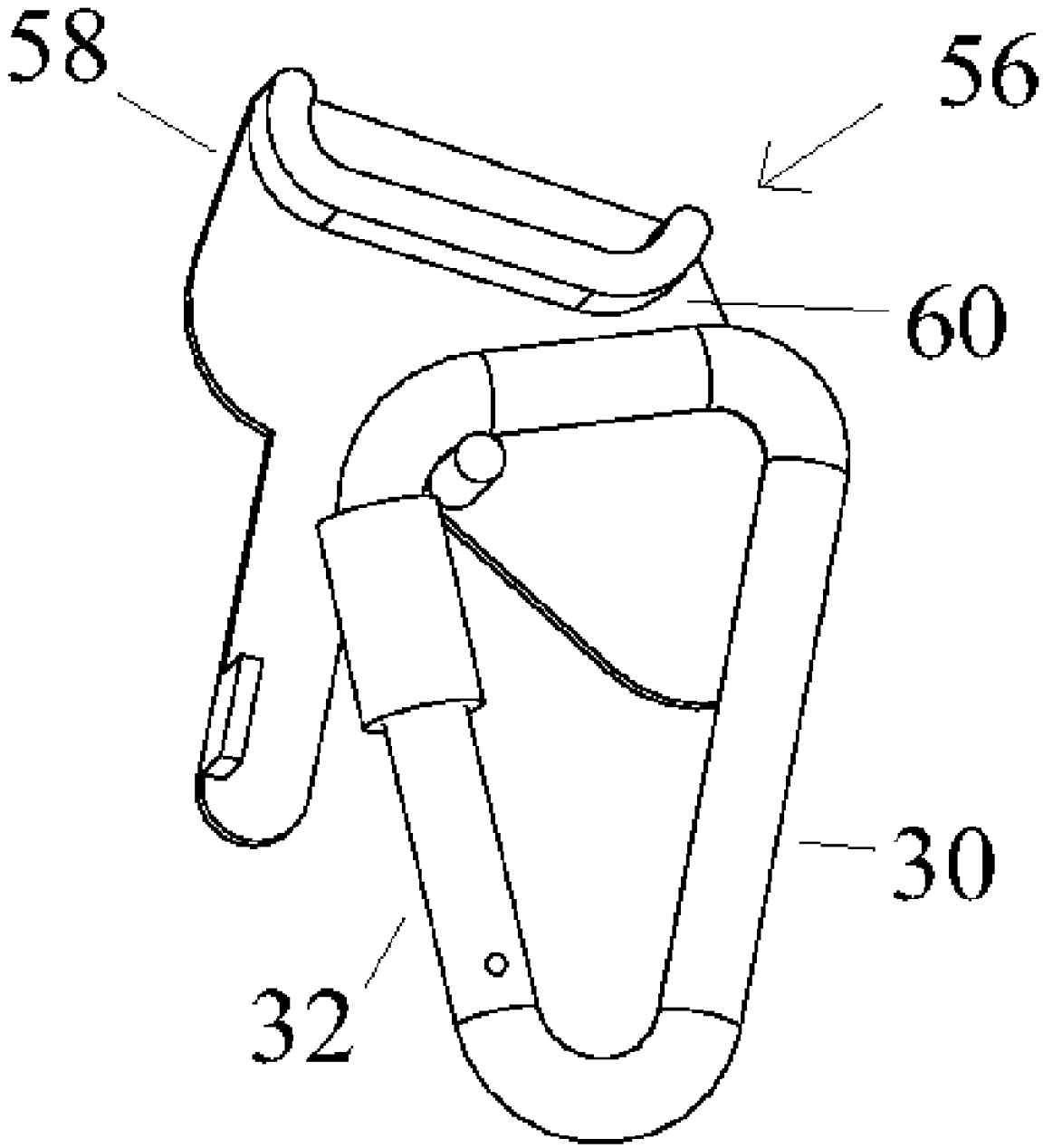

FIG. 17 presents a view similar to that of FIG. 16 but showing components as they would be positioned after the device had locked a rope; illustrating the narrowed channel in which the rope (not shown) would become pinched.

REFERENCE NUMERALS IN DRAWINGS

10 First Embodiment Belay Device
12 Pin
14 Body
16 Inner Channel
18 Inner Forward Surface
20 Inner Rear Surface
22 Inner Top Surface
24 Front Pin Aperture
26 Rear Pin Aperture
28 Rope
30 Locking Carabiner
32 Carabiner Gate
34 Climber End Of Rope
36 Free End Of Rope
38 Rope Pinch Region
40 Second Embodiment Belay Device
42 Extension Arm
44 Second Embodiment Body
46 Second Embodiment Pin
48 Third Embodiment Belay Device
50 Cylindrical Pieces
52 Fourth Embodiment Belay Device
54 Holes
56 Fifth Embodiment Belay Device
58 Fifth Embodiment Body
60 Fifth Embodiment Rope Pinch Region

DESCRIPTION AND OPERATION

Figure 1:
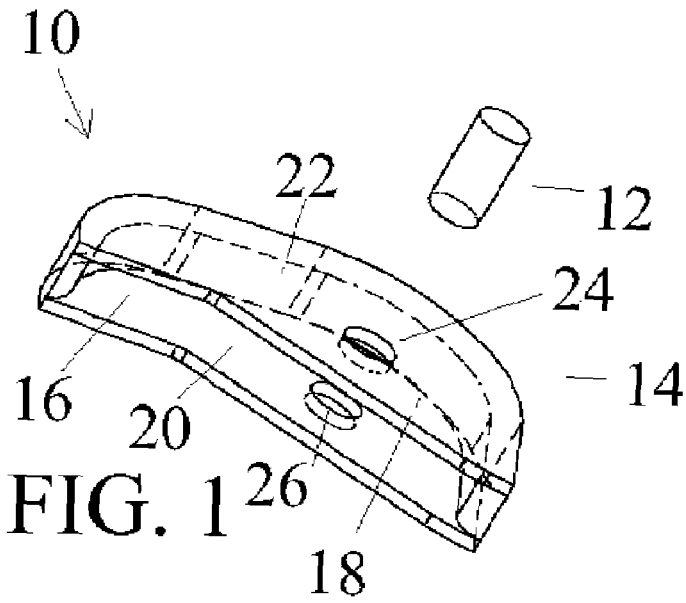
Figure 2:
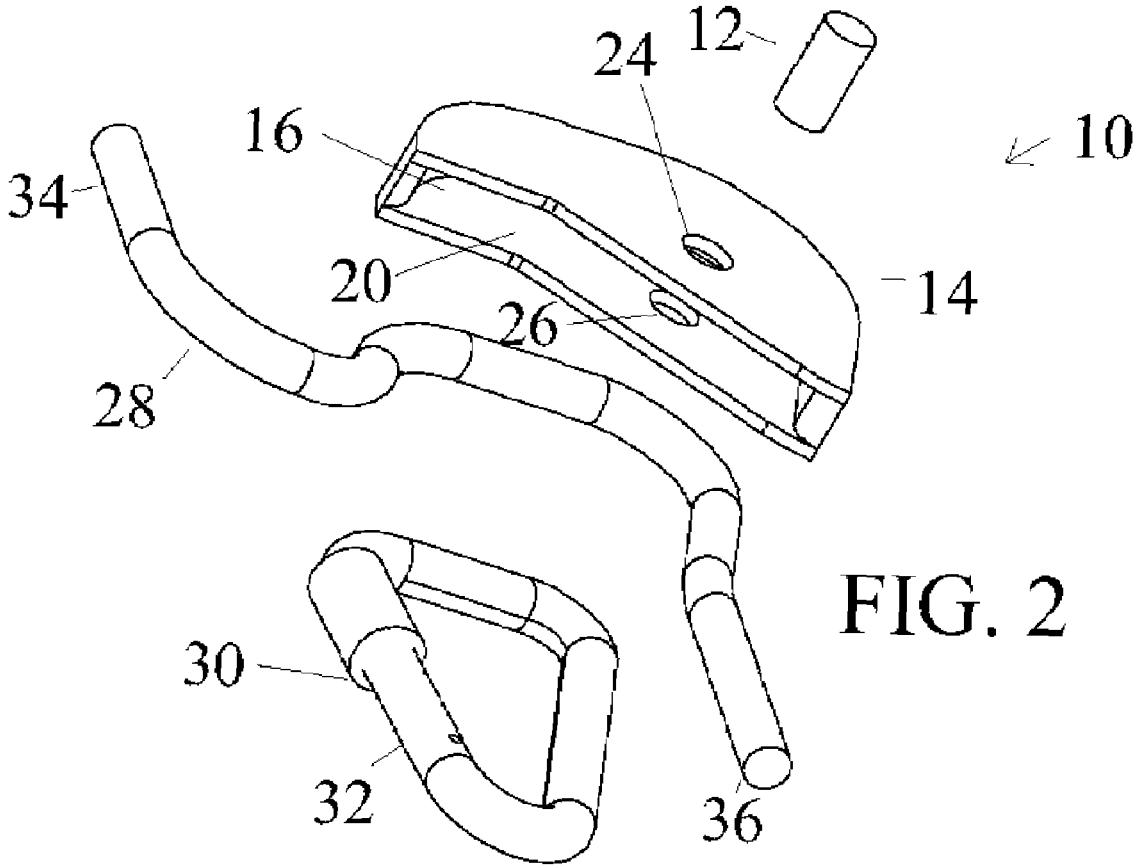
Figure 3:
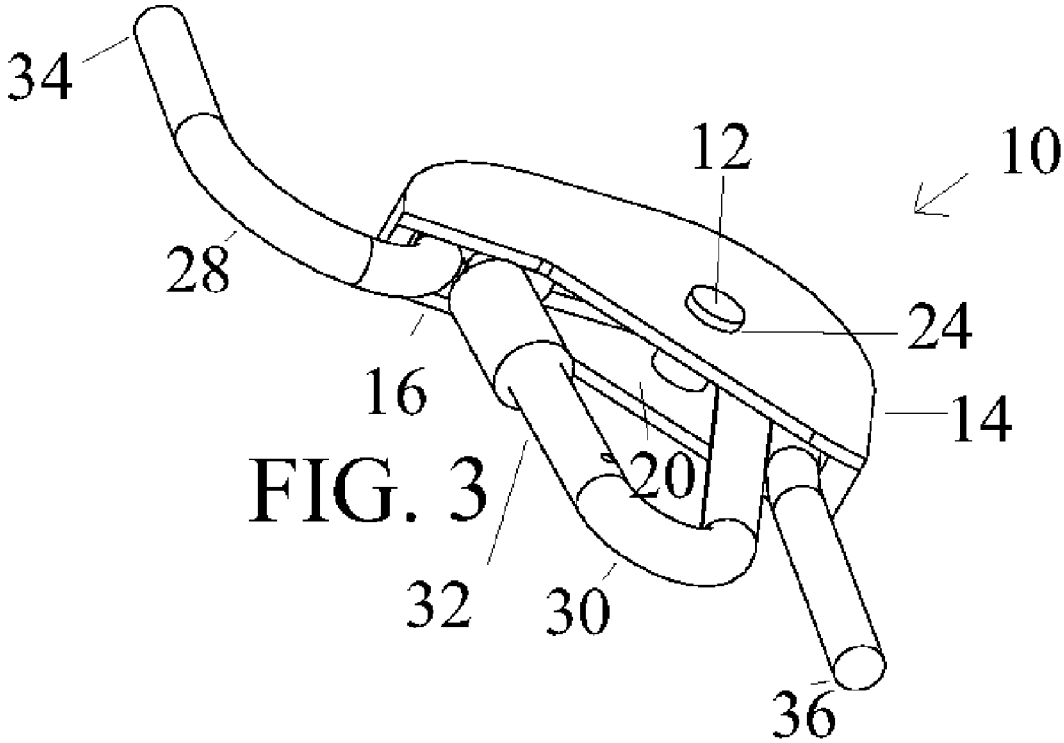
Figure 4:
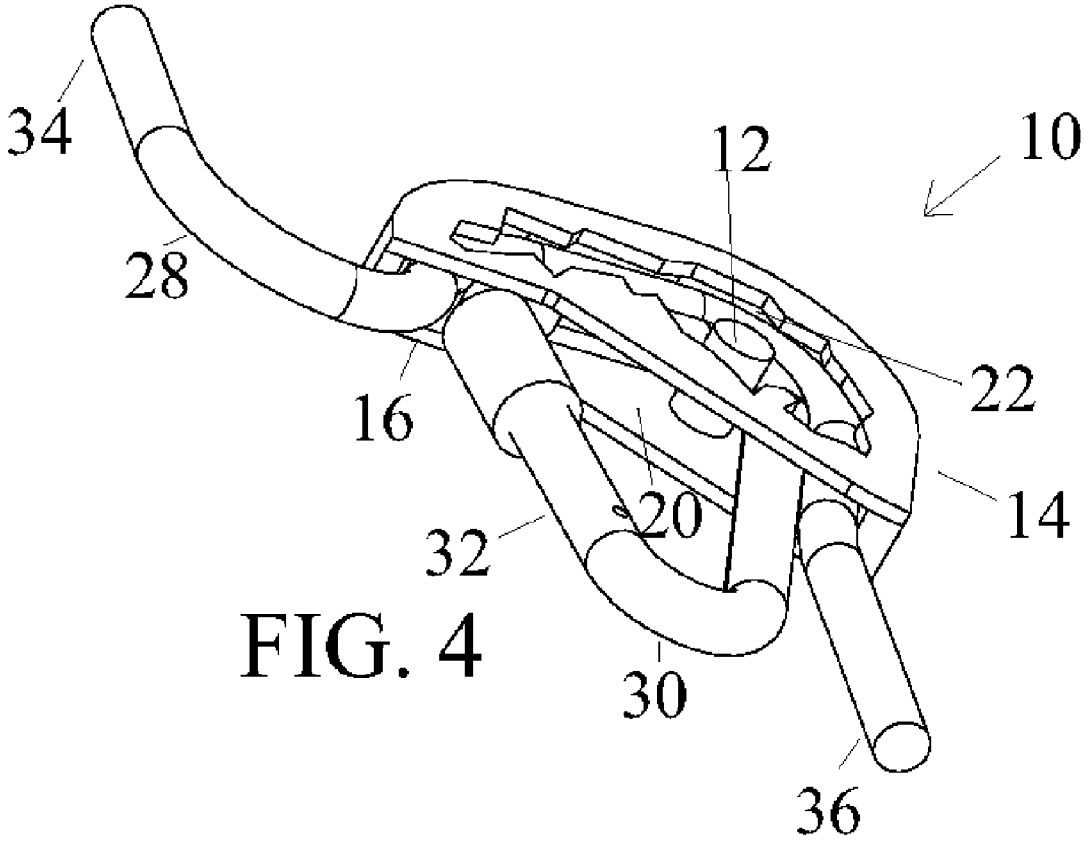

FIG. 1 presents an exploded view, with dashed hidden lines, of a First Embodiment Belay Device (10), consisting simply of a Pin (12) and Body (14). The Body (14) has an Inner Channel (16) with an Inner Forward Surface (18, hidden), Inner Rear Surface (20), and Inner Top Surface (22, hidden). The Body (14) also has a Front Pin Aperture (24) and Rear Pin Aperture (26) for receipt of the Pin (12). FIG. 2 presents another exploded view of this First Embodiment Belay Device (10) along with a Rope (28) and Locking Carabiner (30) which are used with the subject invention but which are not part of the invention itself. FIG. 3 presents the First Embodiment Belay Device (10) in a configuration ready for use; showing the relative placement of the Pin (12), Body (14), Rope (28) and Locking Carabiner (30); and illustrating how the Inner Channel (16) constrains the Rope (28) to a path just outside the Locking Carbiner (30). FIG. 4 presents a view similar to that of FIG. 3 but with a portion of the Body (14) cut away thus better illustrating the relative positions of the First Embodiment Belay Device (10), Rope (28) and Locking Carabiner (30) when the device is ready for use.

To operate the device as a belay device for climbing, the Locking Carbiner (30) is first attached through a loop (not shown) in a belayer's harness (not shown), then locked. A section of the Rope (28) is positioned within the Inner Channel (16). The Locking Carabiner (30) is then inserted into the Inner Channel (16) just behind the Rope (28). The Pin (12) is then inserted through the Front Pin Aperture (24) and received within the Rear Pin Aperture (26) such that the Pin (12) passes through the Inner Channel (16) within the enclosed loop of the Locking Carabiner (30), with one end of the Pin (12) positioned within the Front Pin Aperture (24) and the other end of the Pin (12) positioned within the Rear Pin Aperture (26). The Pin (12) is then secured in the aforementioned position by any number of conventional means (not shown) including, but not limited to, bolt/nut threads, clevis pin type hole with cotter pin, or spring-loaded ball-end. When the Rope (28) is inserted into the Inner Channel (16) care must be taken to ensure that the end of the Rope (28) nearest the Carabiner Gate (32) is the end leading to the climber (not shown), and the end of the Rope (28) nearest the Pin (12) is the free end of the Rope (28). The Climber End Of Rope (34) and Free End Of Rope (36) are designated in the figures.

By lightly holding the Body (14) so that it cannot rotate around the Pin (12) with respect to the Locking Carabiner (30), the Rope (28) can pass in either direction through the device. However, if the Body (14) is not restrained when the Rope (28) is pulled quickly from the Climber End Of Rope (34), the First Embodiment Belay Device (10) locks the rope against further movement. The pull on the Rope (28) from the Climber End Of Rope (34) causes the Locking Carabiner (30) to pivot with respect to the loop in the belayer's harness (not shown) in a manner that causes the Rope (28) to exert upward force on the end of the Inner Top Surface (22) nearest the Climber End Of Rope (34). This upward force causes the Body (14) to rotate around the Pin (12) with respect to the Locking Carabiner (30). This rotation of the Body (14) narrows the distance between the Inner Top Surface (22) and the Locking Carabiner (30) in the region of the Body (14) nearest the Free End Of Rope. This rotation of the Body (14) thus pinches the Rope (28) between a portion of the Inner Tops Surface (22) and a portion of the Locking Carabiner (30) thus locking the Rope (28) against further movement. Once the device has locked the rope, the belayer may free the Rope (28) by exerting force on the Body (14) in a direction which causes the Body (14) to rotate around the Pin (12) with respect to the Locking Carabiner (30) in the opposite direction as that which caused the device to lock the Rope (28).

Figure 5:
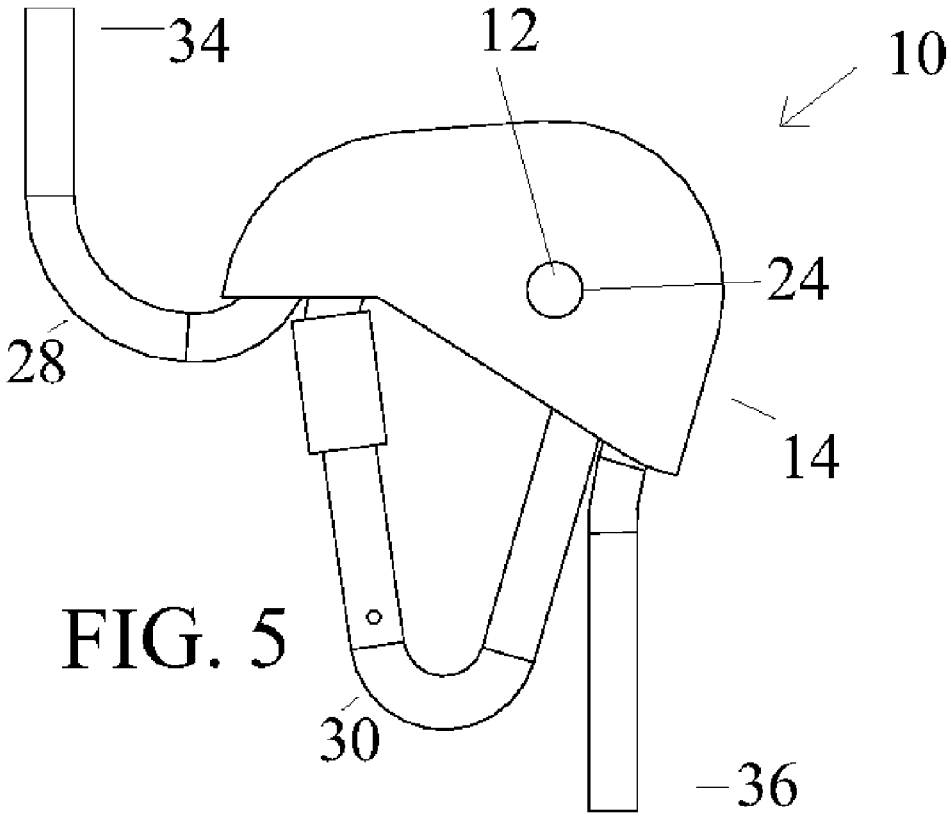
FIG. 5 shows the relative positions of the device, the rope, and the carabiner before the First Embodiment Belay Device has locked the rope.

FIG. 5 presents the First Embodiment Belay Device ready for use. FIG. 6 presents the First Embodiment Belay Device as it looks after having locked the Rope (28) with the Body (14) shown rotated around the Pin (12) with respect to the Locking Carbiner (30). FIG. 7 presents a similar view to that of FIG. 6 but with a portion of the front of the Body (14) cut away thus better illustrating positions of the Rope (28) and Locking Carabiner (30) in the case of the device having locked the Rope (28). FIG. 8 is a perspective view of the First Embodiment Belay Device (10) in the locked configuration, particularly illustrating the region in which the Rope (28) is pinched between the Inner Top Surface (22) and the Locking Carabiner (30), the Rope Pinch Region (38).

Although the following analogy is simplified, physical concepts of circular motion and torque being more appropriate than those of linear motion and leverage, for ease of understanding certain portions of the device can be thought of as acting like a lever. In this analogy, the Pin (12) may be thought of as the fulcrum of the lever. The distance between the Pin (12) and the Inner Top Surface (22) at the point where the Rope (28) leaves the device toward the Climber End Of Rope (34), may be thought of as the long arm of the lever. The distance between the Pin (12) and the Rope Pinch Region (38) may be thought of as the short arm of the lever. The mechanical advantage from the device, controlling the amount of force which is applied to stop the Rope (28) in the Rope Pinch Region (38), is related to the ratio of the length of the long arm of this lever to the length of the short arm of this lever. Since the subject invention offers flexibility to choose the lengths of these lever arms, it offers flexibility to choose the appropriate multiple of the force from a falling object which is used to stop the rope. Also, depending on the shape of the Inner Top Surface (22) in the vicinity of the Rope Pinch Region (38), the area of the surface that contacts the Rope (28) can be changed. This feature allows design flexibility to ensure that sufficient force is applied to stop the Rope (28) but that the force is distributed so as to not damage the Rope (28).

FIG. 9 presents a Second Embodiment Belay Device (40) analogous to the First Embodiment Belay Device (10) but further containing an Extension Arm (42). FIG. 10 presents a perspective view of the Second Embodiment Belay Device (40) further illustrating the Extension Arm (42). As can be seen in the figures, the Extension Arm (42) runs parallel to the Carabiner Gate (32) and a lower portion of the Extension Arm (42) extends in front of the Carabiner Gate (32). The Extension Arm (42) provides two performance enhancements relative to the First Embodiment Belay Device (10). Firstly, the Extension Arm (42) blocks the Second Embodiment Body (44) against counter-clockwise rotation around the Second Embodiment Pin (46) relative to the Locking Carabiner (30). This allows the Rope (28) to be pulled through the device in the direction of the Free End Of Rope (36) without any interference with the movement of the Rope (28). Secondly, the Extension Arm (42) acts as a handle providing leverage to unlock the device in order to lower a climber. Although an extended portion could be placed in many positions to provide leverage to help lower a climber, as FIG. 11 illustrates, the particular placement of the Extension Arm (42) offers a unique advantage. FIG. 11 shows the Second Embodiment Belay Device (40) in a locked configuration, illustrating how the Extension Arm (42) rotates away from the Carabiner Gate (32) when the device locks. A belayer can easily lower a climber by gently squeezing the Extension Arm (42) back toward the Locking Carabiner (30).

FIG. 12 presents a Third Embodiment Belay Device (48) illustrating one of many ways to remove weight from the device. Relative to the First Embodiment Belay Device (10) the continuous Inner Top Surface (22) has been removed and replaced with a series of Cylindrical Pieces (50). FIG. 13 presents a top view of the Third Embodiment Belay Device (48) further illustrating the Cylindrical Pieces (50). The Cylindrical Pieces (50) provide the same features of integrity, rope confinement, rope guidance, and rope pinch surface, as provided by the Inner Top Surface (22) of the First Embodiment Belay Device (10), while weighing less.

FIG. 14 presents a Fourth Embodiment Belay Device (52) illustrating another method to achieve a lighter weight device. The Fourth Embodiment Belay Device (52) has a series of Holes (54) which allow for decreased weight without affecting functionality.

FIG. 15 presents a Fifth Embodiment Belay Device (56) in which the Rope (28) need only contact one side of the Locking Carabiner (30). FIGS. 16 and 17 present the Fifth Embodiment Belay Device (56) with the front of the Fifth Embodiment Body (58) removed to show the internal positions of the various elements. FIG. 16 shows an unlocked configuration. FIG. 17 shows a locked configuration illustrating the Fifth Embodiment Rope Pinch Region (60) (rope not shown).

CONCLUSION, RAMIFICATIONS, AND SCOPE

Thus the reader will see that the simple belay device of the subject invention provides a simple economical device that optimizes the desired performance characteristics. The simple belay device makes use of advantages derived from placing the locking carabiner in the same geometric plane as that of the rope path through the device. This unique and counter-intuitive design offers a very simple device that achieves better mechanical advantage properties than those of prior art devices with few or no moving parts, while also being relatively more gentle on the rope. With respect to the sport of rock climbing, it can function either as a belay device or as a descender. It can also be used in a variety of situations to lower an object in a controlled fashion.

While the above description contains many specifics, these should not be construed as limitations on the scope of the invention, but rather as examples of five embodiments thereof. Each piece described within the aforementioned embodiments could be changed in form in ways that would not affect its function. Accordingly, the scope of the invention should be determined not by the embodiments illustrated, but by the appended claims and their legal equivalents.

What is claimed is:

1. A device used, in conjunction with a rope, to control the movement of a weight attached to said rope; providing simplicity, economy, and enhanced mechanical advantage properties by deriving multiple functionalities from a carabiner; said carabiner providing a means to attach said device to an anchor point, supporting a entire path of said rope through said device, constraining an axis of rotation around which a main body of said device rotates, and providing one of two surfaces between which said rope is pinched in order to inhibit movement of said rope; said device comprising:

a) a carabiner;

b) a main body having a rope channel; said main body comprising a front face, a back face, and a top face connecting the front and back faces and extending throughout the top of the main body; said rope channel residing between said front face and said back face and below said top face; one side of said rope channel, opposite said top face, thus being open to allow insertion of a segment of said rope into said rope channel; the width of said rope channel, defined as the distance between an inner surface of said front face and an inner surface of said back face, being only slightly in excess of a tubing diameter of said carabiner; the depth of said rope channel being greater than the sum of the diameter of said rope and the diameter of said carabiner tubing; said rope channel thus adapted for placement of a segment of said rope and a segment of said carabiner tubing; a path of said rope through said rope channel lying within the same geometric plane as that of a loop formed by said carabiner;

c) a carabiner attachment and main body pivot means; said carabiner attachment and main body pivot means both enabling said main body to be attached to said carabiner and providing an axis of rotation allowing said main body to rotate with respect to said carabiner;

in operational configuration; said carabiner being attached through a loop at a desired anchor point; a segment of said rope being positioned within said rope channel; a segment of said carabiner tubing also being positioned within said rope channel, below said segment of said rope, and secured by said carabiner attachment and main body pivot means; said segment of said carabiner tubing thus blocking the otherwise open side of said rope channel thus preventing removal of said rope, supporting said rope, and confining the movement of said rope to forward or backward movement in the direction of said path of said rope through said rope channel; drag forces generated by rapid movement of said rope in the direction toward said weight causing said main body to rotate with respect to said carabiner, by way of said carabiner attachment and main body pivot means, such that an end of said top face, nearest said weight, moves away from said carabiner tubing, and an end of said top face, farthest from said weight, moves closer to said carabiner tubing thus pinching said rope between said end of said top face farthest from said weight and a portion of said carabiner tubing, thus restricting movement of said rope; manual application of force by an operator of said device allowing said main body to be rotated with respect to said carabiner such that the pinch of said rope is released thus again allowing movement of said rope, wherein said carabiner attachment and main body pivot means comprises a front aperture in said front face, a rear aperture in said rear face, said apertures being located at a substantially central location on said front and rear faces, and a pin; portions of said pin extending through both said front aperture and said rear aperture; another portion of said pin extending across said rope channel and positioned within said carabiner; the positions of said front aperture within said front face and of said rear aperture within said rear face being such that a portion of said rope is held closely to said top face by a portion of said carabiner tubing which, in turn, is held in place by said pin; movement of said rope through said device in the direction of said weight causing said main body to rotate around said pin with respect to said carabiner; further comprising a rotation blocking means; said rotation blocking means being attached to said main body and positioned so as to contact said carabiner to prevent further rotation of said main body in the event that forces tend to rotate said main body with respect to said carabiner in the direction opposite from the desired rotational direction to lock said rope; said rotation blocking means thus preventing the inhibition of said rope movement when said rope is pulled through said device in the direction away form said weight.

2. The device of claim 1 further comprising an extension arm; said extension arm being attached to said main body and extending outward away from said carabiner attachment and main body pivot means; said extension arm thus functioning as a handle providing leverage for said operator of said device to apply force to rotate said main body with respect to said carabiner such that the pinch of said rope can be released after said device has locked said rope.

3. The device of claim 2 wherein said extension arm is positioned close to, and relatively parallel to, a side of said carabiner; said extension arm further being positioned such that said extension arm rotates slightly away from said side of said carabiner when said device locks said rope; said operator thus being able to remove said pinch on said rope by squeezing said extension arm against said side of said carabiner.

4. The device of claim 2 wherein the shape of said extension arm is such that said extension arm contacts said carabiner to prevent further rotation of said main body in the event that forces tend to rotate said main body with respect to said carabiner in the direction opposite from the desired rotational direction to lock said rope; said extension arm thus preventing the inhibition of said rope movement when said rope is pulled through said device in the direction away from said weight.

* * * * *